United States Patent [19]

Johnson et al.

[11] Patent Number: 4,936,038

[45] Date of Patent: Jun. 26, 1990

[54] HANDGUN KEEPER

[76] Inventors: Merlyn B. Johnson, 2904 Joan La., Billings, Mont. 59102; Brycelyn B. Johnson, 4401 NW. 39th St., Apartment 524, Oklahoma City, Okla. 73112

[21] Appl. No.: 362,360

[22] Filed: Jun. 7, 1989

[51] Int. Cl.[5] ..... A47B 81/00

[52] U.S. Cl. ..... 42/106; 312/204; 211/64

[58] Field of Search ..... 42/99, 70.11, 106; 312/204; 109/51, 68; 206/317; 211/64; 248/201

[56] References Cited

U.S. PATENT DOCUMENTS

| | | | |
|---|---|---|---|
| Re. 17,510 | 12/1929 | Hoegger | 312/204 |
| 3,109,685 | 11/1963 | Skorupa | 312/204 |
| 3,140,134 | 7/1964 | Nairn | 312/204 |
| 3,307,755 | 3/1967 | Lentz | 42/70.11 |
| 3,468,427 | 9/1969 | Leslie | 206/317 |
| 4,155,608 | 5/1979 | Orlewicz | 312/204 |
| 4,198,026 | 4/1980 | Capolupo | 42/70.11 |
| 4,299,045 | 11/1981 | Cervantes | 42/70.11 |
| 4,304,447 | 12/1981 | Ellwood et al. | 312/204 |

*Primary Examiner*—Charles T. Jordan
*Assistant Examiner*—Michael J. Carone

[57] ABSTRACT

A handgun keeper for use with a handgun comprising two wooden frames of similar size, two hinges pivotally connecting the two frames such that the front frame is overlying the back frame, the front frame defining a picture frame and including matting enclosing its backside, the front frame containing clear glass and matted picture print, the backside of the front frame further including a metal tab attached thereto, the back frame having a means for attaching to a wall and being completely enclosed on its backside with a masonite backing, the back frame further including a round magnet disposed in an inset in a front surface thereof which is aligned with the metal tab on the backside of the front frame such that the magnet will magnetically engage the metal tab thereby holding the two frames together in a closed position, a magnetic holding device comprising a ceramic bar magnet and a strip of metal having two ends, one end of the strip of metal being attached to the bar magnet, and the other end being attached to the masonite backing, a wooden block having an upper flat surface attached to the masonite backing spaced from the holding device, the holding device lies against and magnetically holds the barrel of a firearm while the butt of the handgun lies on the upper surface of the block.

1 Claim, 3 Drawing Sheets

HANDGUN KEEPER

This invention relates to a novel assembly of two wooden frames constructed and connected together in a manner that conceals a handgun between two said frames. A novel magnetic device is used to secure or retain the gun in position in the space between the two frames. A ceramic bar magnet and metal piece comprise the device.

Handgun owners often have a handgun lying in a drawer or in a cabinet that allows easy accessibility by children or others. This invention, attached to a wall, conceals a handgun and keeps the gun out of reach of small children.

Handgun owners often place a handgun in a secluded hiding place failing to make the gun readily accessible. This invention not only hides the gun but secures it in a manner that allows it to be easily and quickly retrieved.

Additionally, this invention when attached to a wall simply appears to be a wall hung picture adding decor to a room. Children and others will not readily know that a handgun is concealed behind the picture frame unless shown.

Other benefits and advantages of the invention will be apparent from the following descriptions and accompanying drawings in which.

Figure 1:
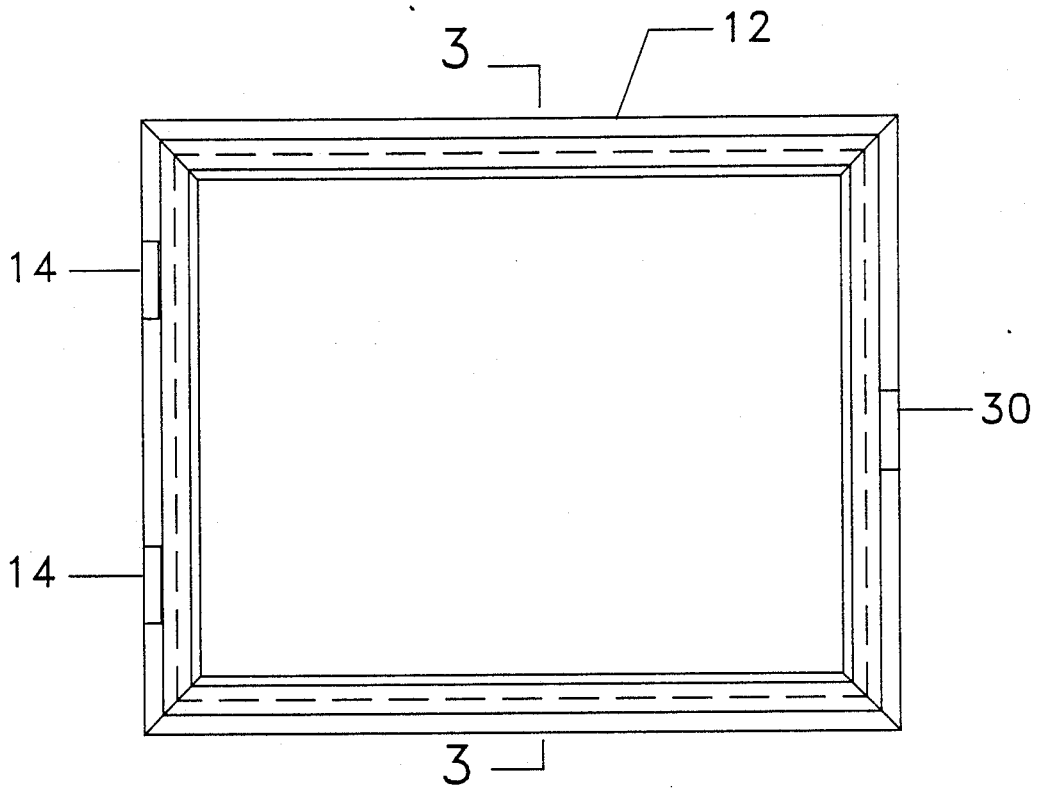
FIG. 1 is a front elevation of the front frame of the invention.
Figure 2:
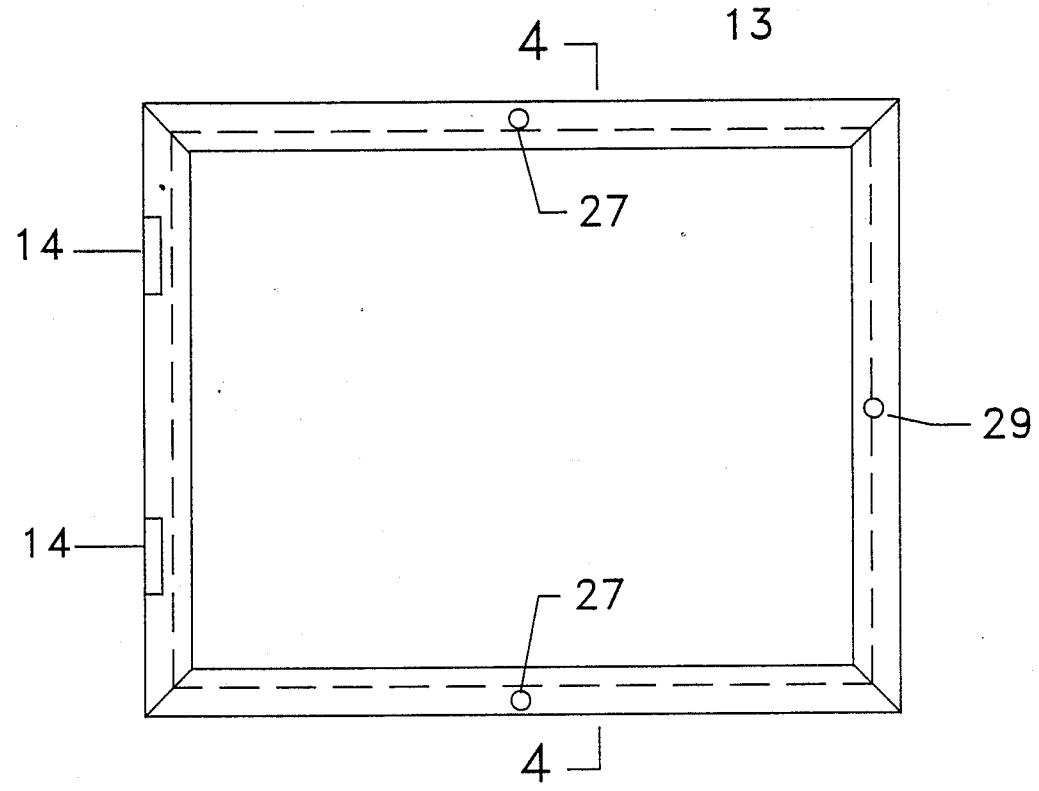
FIG. 2 is a front elevation of the back frame.
Figure 3:
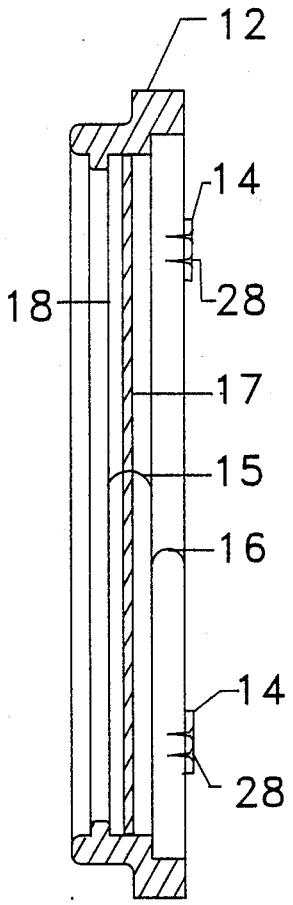
FIG. 3 is a sectional view taken along line 3—3 of FIG. 1.
Figure 4:
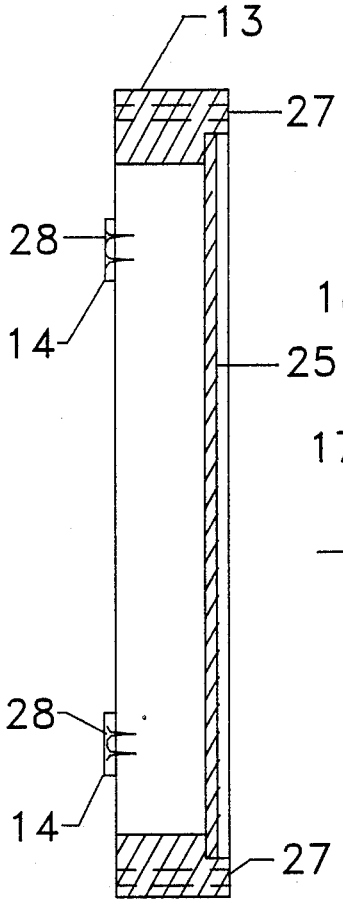
FIG. 4 is a sectional view taken along line 4—4 of FIG. 2.
Figure 5:
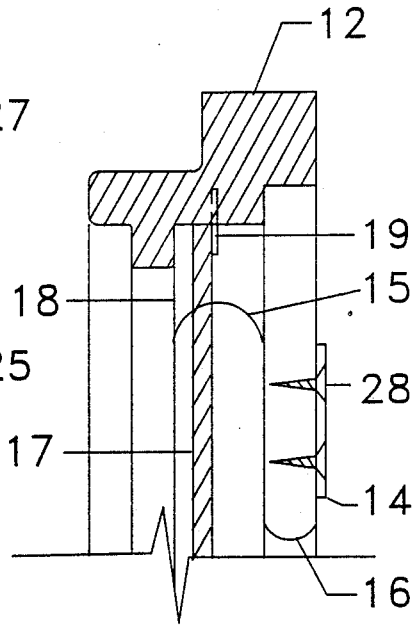
FIG. 5 is a side view of the upper portion of FIG. 3.
Figure 6:
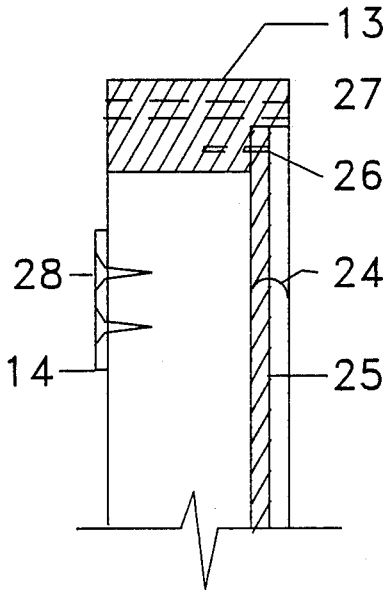
FIG. 6 is a side view of the upper portion of FIG. 4.

As shown in the drawings, two wooden picture like frames 12 and 13 are constructed of similar size. Two brass hinges 14 pivotally connect the two frames together comprising a single unit. Certain light nonferrous metals or plastic resins could be used in constructing the frames other than wood.

The front frame 12 is constructed of conventional wooden picture frame molding that is readily available on the open market. The frame molding requires a double rabbet 15 and 16. A pane of glass 18 is placed within the borders of rabbet 15. In addition, a picture print and matt board 17 are placed behind the glass 18. The matt board is positioned with finished side exposed and secured with wire staples 19. The staples can be bent for easy removal of matt, picture print and glass.

The back frame 13 is custom molded or shaped. A rabbet 24 is cut in the backside of the frame parts. A solid masonite backing 25 is cut to fit within the borders of the rabbeted area of the assembled frame. The masonite is secured firmly with wire staples 26. Two holes 27 are drilled through the upper and lower frame parts of the back frame. The holes are positioned in the center of the parts equal distance from their respective ends. Two wood screws are inserted through the holes to attach the novel invention to a wall.

The two frames are pivotally connected together using two brass hinges 14. Screws 28 are used to attach the hinges to the front and back frames. The hinges are attached to the corresponding side part of each frame. One hinge portion is positioned on the front surface of the back frame, the other portion on the backside surface of the front frame.

A round ceramic magnet with two flat surfaces 29 is positioned in the front surface of the side part of the back frame. A shallow hole is drilled in the front surface of a side part. The magnet is inset in the hole using glue to secure it in place.

A metal tab 30 is positioned on the back surface of the side part of the front frame. The tab is glued to the back surface of the front frame in a position directly opposite the magnet of the back frame. When the front and back frames are closed, the magnet and metal tab meet, causing a magnetic force that holds the frames in a closed position.

Figure 7:
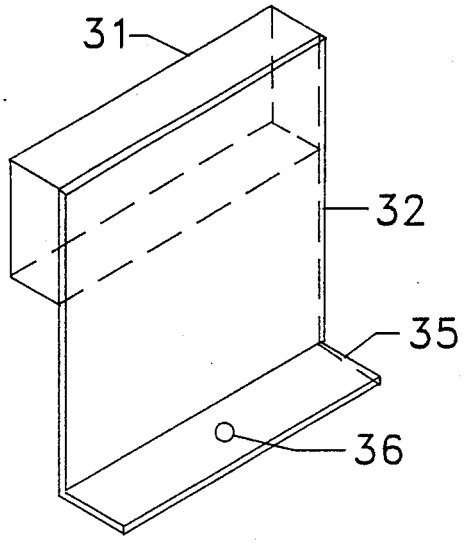
FIG. 7 is a perspective view of the assembled magnetic device.

A magnetic device FIG. 7 is used to secure the handgun and retain it in a position. The device includes a ceramic bar magnet 31 and a piece of metal 32. A flange 35 is bent at the bottom edge of the metal piece. A hole 36 is made in the center portion of the flange. The bar magnet is glued to the backside of the metal piece 32. The top edges of magnet and metal piece and respective side parts are positioned evenly with one another. A truss bolt 33 and nylon lock nut 34 are used to attach the magnetic device to the masonite backing. The nut is not tightened firmly but to a degree that allows the magnetic device to rotate slightly. This allowable rotation permits the magnet to seek maximum attachment to the gun barrel achieving firm magnetic adhesion.

The design of the magnetic device, when attached to the backing, creates a "Vee" shaped trough 38 between the masonite backing and face of the magnet. This area houses the barrel of the handgun. The size of this area can be increased or decreased by simply bending the flange of the metal piece. With the magnetic device attached to the backing, the metal piece and magnet can be bent easily towards the backing to decrease the size of the "Vee" shaped area or bent away from the backing increasing said area size. This adjustment factor makes the device very versatile since it can be easily and quickly conformed to gun barrels of various diameters and shapes.

Figure 8:
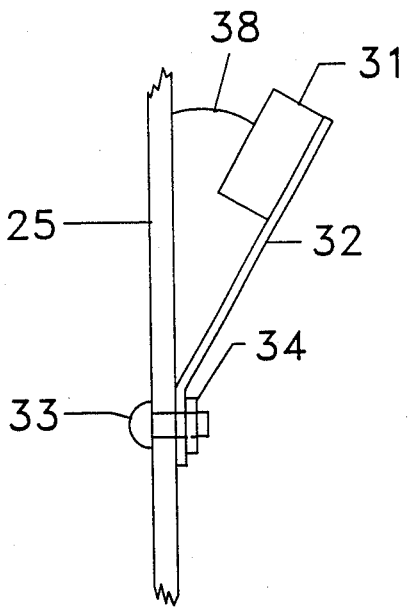
FIG. 8 is a side view of the magnetic device attached to the masonite backing of back frame.
Figure 9:
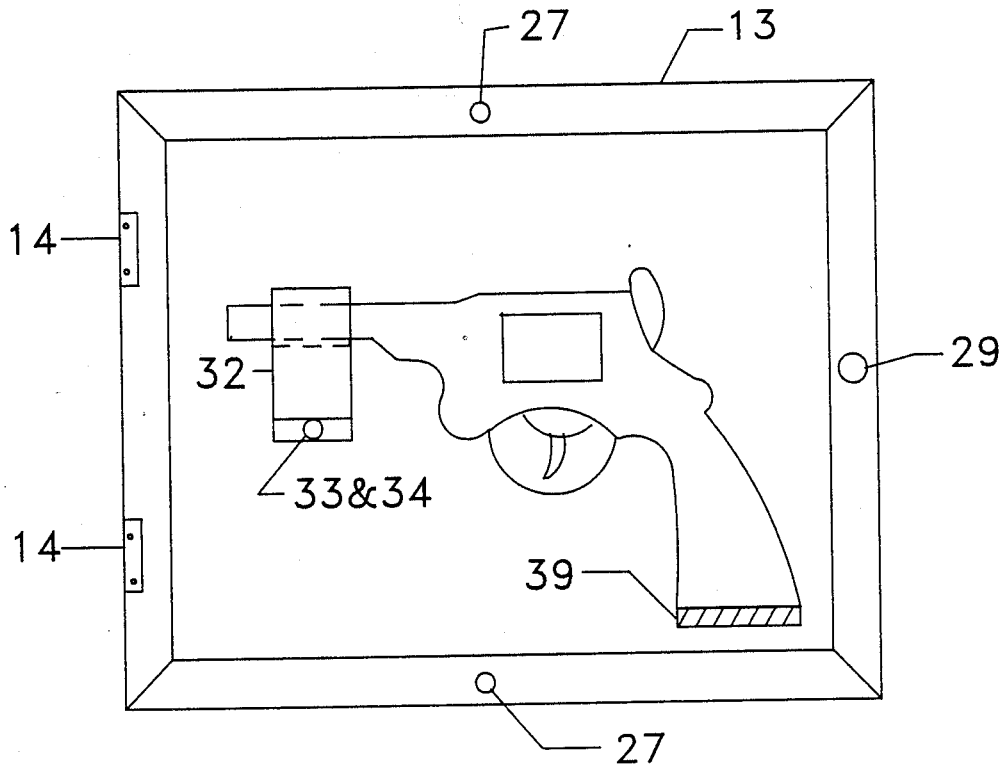
FIG. 9 is a front view of the magnetic device attached to the masonite backing of the back frame with handgun in place.

With the frames in a closed position, ample space is provided between the frames for housing a handgun. The space is bordered by the interior borders of all frame parts of the front and back frames and the backside surface of the picture matting of the front frame and anterior surface of the masonite backing of the back frame. Attaching the magnetic device to the masonite backing is accomplished easily and quickly with tools that exist in most homes. The magnetic device is placed on the backing in a manner that forms a "Vee" shaped trough between the backing and the magnet. The gun barrel is placed in the trough. The magnet will grasp the barrel firmly. The top edge of the magnetic device is aligned parallel with the gun barrel. When the gun and magnetic device are attached to one another, they are then positioned in a satisfactory manner within the space between the frames, and the hole of the magnetic device is marked at an appropriate location on the backing of the back frame. A hole is then drilled through the backing at that mark. From the backside of the backing, a bolt is then inserted through the backing and the hole in the flange of the magnetic device. A nylon lock nut is placed on the bolt, but not tightened too firmly so as to permit the magnetic device to move somewhat freely. A small wooden block 39 is glued to the backing, positioned under the base of the handgrip of the gun. The block of wood also helps in securing the handgun in a position which permits easy and quick retrieval. The final result should simulate that shown in FIG. 8.

What is claimed is:

1. A handgun keeper for use with a handgun including a front frame and a back frame, two hinges pivotally connecting the two frames such that the front frame is overlying the back frame, the keeper further defined by:

(a) the front frame defining a picture frame and including picture matting enclosing its backside, the backside of the front frame further including a metal tab attached thereto;

(b) the back frame having a means for attaching to a wall and being completely enclosed on its backside with a masonite backing, the back frame further including a round magnet disposed in an inset in a front surface thereof which is aligned with the metal tab on the backside of the front frame such that the magnet will magnetically engage the metal tab thereby holding the two frames together in a closed position;

(c) a magnetic holding device comprising a ceramic bar magnet and a strip of metal having two ends, one end of the strip of metal being attached to the bar magnet, and the other end being attached to the masonite backing: and (d) a block having an upper flat surface attached to the masonite backing spaced from the holding device; wherein the holding device lies against and magnetically holds the barrel of a firearm while the butt of the handgun lies on the upper surface of the block.

* * * * *